US007485050B2

(12) United States Patent
Rose

(10) Patent No.: US 7,485,050 B2
(45) Date of Patent: Feb. 3, 2009

(54) MICROPATTERN GRIP SURFACE

(75) Inventor: Timothy Rose, Brea, CA (US)

(73) Assignee: Grip Surface Technologies, Inc., Los Angeles, CA (US)

( * ) Notice: Subject to any disclaimer, the term of this patent is extended or adjusted under 35 U.S.C. 154(b) by 0 days.

(21) Appl. No.: 11/332,993

(22) Filed: Jan. 17, 2006

(65) Prior Publication Data

US 2007/0082748 A1 Apr. 12, 2007

Related U.S. Application Data

(60) Provisional application No. 60/726,074, filed on Oct. 12, 2005.

(51) Int. Cl.
*A63B 53/14* (2006.01)

(52) U.S. Cl. ..... 473/303

(58) Field of Classification Search ..... 473/300–303, 473/568, 549–552; D21/756; D8/DIG. 6–8; 74/551.9; 81/489; 16/421, 430, DIG. 12, 16/DIG. 18–19; 280/821
See application file for complete search history.

(56) References Cited

U.S. PATENT DOCUMENTS

D268,944 S * 5/1983 Southey ..... D21/756
5,087,042 A * 2/1992 Solheim ..... 473/303
5,584,482 A * 12/1996 Huang ..... 473/301
5,637,043 A * 6/1997 Fortis ..... 473/302
6,800,234 B2 10/2004 Ferguson et al.
2002/0169031 A1 * 11/2002 Wallace et al. ..... 473/303
2003/0088946 A1 5/2003 Ferguson et al.

* cited by examiner

*Primary Examiner*—Stephen L. Blau
(74) *Attorney, Agent, or Firm*—Ostrolenk, Faber, Gerb & Soffen, LLP

(57) ABSTRACT

A micropattern grip surface for use on a grip, and particularly a grip for a golf club, wherein the pattern includes alternating upstanding ridges and grooves between the ridges. In a preferred embodiment, the ridges extend with a generally longitudinal direction of extension component on the grip with a generally circumferential direction of extension component and also may be parallel. The ridges in an embodiment zigzag along the longitudinal direction. In an embodiment, at intersections or bends between the zig and the zag line elements, additional free end barbs extend from the intersections. The density, width and height of the line elements of the ridges are selected to provide drag on the hand or object gripping the grip, preferably in both the longitudinal and circumferential directions, and to give the grip a velvety feel. Alternatively, each of the ridges is comprised of some line elements. Each ridge or a set of line segments thereof may be aligned in a direction of at least one of longitudinally along, circumferentially around, obliquely to the axis or spirally around the grip surface.

10 Claims, 1 Drawing Sheet

MICROPATTERN GRIP SURFACE

CROSS-REFERENCE TO RELATED APPLICATION

This application is based upon and claims benefit of U.S. Provisional Application No. 60/726,074, filed Oct. 12, 2005, to which a claim of priority is hereby made.

BACKGROUND OF THE INVENTION

Hand grips on golf clubs and other objects have a circumference which is grasped in a user's hand. Typically, the circumferential surface is at least in part rounded or curved, and may also include flat areas.

Gripping the grip tightly enough should prevent movement of the grip longitudinally along a long axis and/or circumferentially around the axis. The grip surface should be comfortable for the person holding the grip. Further, it would be beneficial for the grip surface to enable removal of moisture, oil, perspiration, etc. from the person's hand when holding the grip, and have a surface which allows the grip to be held with the least amount of hand pressure.

There are various designs of hand grips, of which golf grips are an example, which are designed to accomplish at least some of these functions. Some grips have a smooth surface, which is difficult to hold when force is applied to the grip or to the object including the grip, including force applied either around the axis of the grip, that is torsional force, or force applied longitudinally along the axis. A smooth grip must be held more tightly than a roughened grip, thus compromising the performance of a golf club or like products. The surface of the grip may be roughened, for example due to the inherent roughness of a particular material used or due to some treatment of the grip surface. As another example, ribs or grooves may be formed at spaced intervals on the grip and may be oriented either circumferentially, longitudinally, obliquely or spirally on the grip; and parallel, oblique to each other or intersecting; or in combinations of all of these. There may be molded or otherwise formed protrusions as shown in U.S. Pat. No. 6,800,234 and U.S. Application Publication No. 2003/0088946A1.

Arranging elements on the grip to resist slippage in the longitudinal direction may provide good feel and drag circumferentially, but not longitudinally. Arranging the elements circumferentially may provide good feel and drag longitudinally, but not circumferentially.

An objective of the designer of a grip surface is to have the grip create a "drag" on the gripping hand, so that when the grip is securely gripped, and torsion is thereafter applied to the grip by use of the object to which the grip is attached, as occurs when a golf club is swung and a golf ball is hit for example, the drag resists the torsion and also prevents the grip from slipping from the hand along the axis direction. With light gripping hand pressure (which is made possible by the invention), a golfer will yield the best performance of the golf club and improve his game. People also like a "velvety" feel on the grip, which provides a comfortable feel, not too slick and not too coarse or rough, which restricts how a grip surface is to be formed for achieving desirable drag.

The majority of golf grips currently being sold are buffed grips. This means that they have a surface that has been sanded. This buffed grip provides a velvety feel to the user. However, particularly when a rubber material grip is sanded, the sealed surface skin of the rubber of the grip is removed and the pores of the rubber are exposed to air, sweat, and oil from the hands. The grip actually absorbs elements from the environment and from the hand, eventually making the originally velvety feel grip later feel hard or slick, and the velvety feel is lost. In most cases, by the time a golf club is purchased from a retailer and a golfer has begun playing with it, the grip has lost most of its velvety feel before it first goes into play. If a purchaser wants a velvety feel of the grip at least when he purchases the clubs, the loss of the velvety feel of the grip of one club can negatively impact the sale of the golf club and even of a set of golf clubs.

SUMMARY OF THE INVENTION

The invention concerns a repetitive surface pattern on a grip, particularly a golf grip, that is quite fine and which is called a micropattern.

The microsurface gripping pattern or micropattern may be defined as an array of upstanding features in the grip material, and in one particular version here, may be comprised of multi-directional lines, arches, or the like. The grip is preferably of rubber, TPE (thermo plastic elastomer), or another elastomeric material.

In one preferred embodiment, the gripping pattern is a continuous pattern of sets of interconnected line elements, wherein a set of line elements defines a generally longitudinally extending, zigzag line. The set of line elements may extend longitudinally along the length direction of the grip, or circumferentially around the grip, in an oblique direction between longitudinal and circumferential, spirally wound around the grip, or combinations of some of these. A set of line elements may be in one continuous line, or a few line elements spaced from another set of a few line elements, with each set of line elements providing a part of a longer line made up of sets of line elements. Herein, a set of line elements joined in sequence and defining part of a longer line of sets of line elements is called a line segment.

The pattern of line segments features individual upraised or protruding line elements of a height of about 0.010-0.040 inch and a line width of about 0.003 to 0.030 inch.

In a preferred embodiment, the lines of line elements each extend generally longitudinally along the grip. In a preferred design, the spaces or grooves between circumferentially neighboring upraised line segments is about the same width as the width of the line segments.

The length of each line element between successive zigzag direction changes in a set of line elements in a line segment is about 0.025 to 0.250 inch.

There is no single required shape or orientation of the pattern, its lines, line segments and the line elements, and possible variations are noted above. However, the shape and orientation are selected so that the micropattern produces drag both in the circumferential and longitudinal directions. To achieve this, the micropattern has lines or shapes running in longitudinal directions and circumferential directions and preferably at least some running obliquely to both those directions.

The number of pattern segments, pattern repeats, line elements or line segments in a particular area of the grip is not as significant as the fineness and density of the pattern and the height of the ridges and/or the depths of the intermediate grooves. The micropattern extends over and covers all of the grip or only a part, depending on the grip designer's preference.

In a preferred embodiment, the micropattern is preferably formed in the mold cavity tool which forms the grip product. This micro pattern is formed in the mold cavity tool, using a laser engraving process. The inventor has discovered the ability to produce those surface patterns in microdetail by laser engraving. He has found that the micropattern is not so easily produced by other currently available tool manufacturing, engraving or chemical texturing methods.

In a preferred form, the micropattern is defined by alternating ridges and grooves in the grip surface. This grip surface has an approximately equal number of upstanding ridges and grooves since the width of the ridges and the grooves is preferably about the same, so that the gripping surface has even coverage of ridges and grooves, or male and female features. While some deviation from this uniformity may not affect the feel and the drag of the grip, excess deviation may cause the gripping pattern to lose a velvety feel. Depending upon ridge height, if the groove width exceeds about four to ten times the width of the ridges, or vice versa, the feel can be severely compromised.

The groove and ridge pattern may have any of several preferred forms. In one form, each ridge extends continuously with successive line elements alternating at zig and zag angles, achieving the multi-directional grip feel and drag. The zigzag line may be continuous or may be discontinuous with individual "lightning bolt" line element sets, here called line segments, made up of several line elements. The zigzag arrangement appears to fill up the gripping surface area with a pattern, so as not to leave void areas lacking any pattern.

A zigzag pattern suggests sharp changes in direction at intersections between the ends of adjacent line elements. But the golf grip will function well with the intersections between line elements rounded somewhat, on a radius, even to the extent of the line elements being in almost sine wave form.

The zigzag lines may have additional projecting "barbs" projecting from the intersections between adjacent line elements, but possibly along the length of a line element. In addition to the alternating directions of extension of zigzag ridges causing drag in both the longitudinal and circumferential directions, the barbs have ends which effectively increase resistance or drag of the barbs against the user's hand, enhancing the drag of the grip.

The pattern can be comprised of upstanding ridges having continuous length in the longitudinal direction or can be made up of segments of ridges or line segments where the pattern would be segmented and providing a density of details of about 1,000 details per square inch or less.

The gripping surface pattern may be made of rubber or another elastomeric material. It is undesirable for the pattern to be manufactured of rigid material, since the feel would be lost because the pattern features would not flex when squeezed by the user's hand.

The ridges and grooves provide a multidirectional feel in a golfer's hand under both torque and longitudinal force and movement. The pattern also wipes away perspiration from the user's hand.

DESCRIPTION OF THE PREFERRED EMBODIMENT

Figure 1:
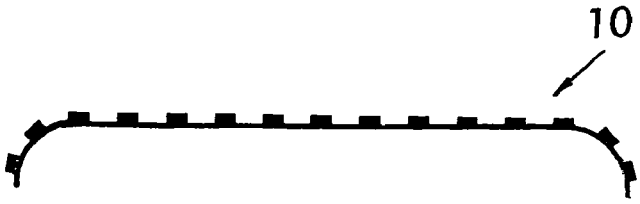
FIG. 1 is an edge view of a surface that may be the surface of a golf grip or any other object provided with a preferred embodiment of the invention, viewed in the direction of arrows 1 in FIG. 2.
Figure 2:
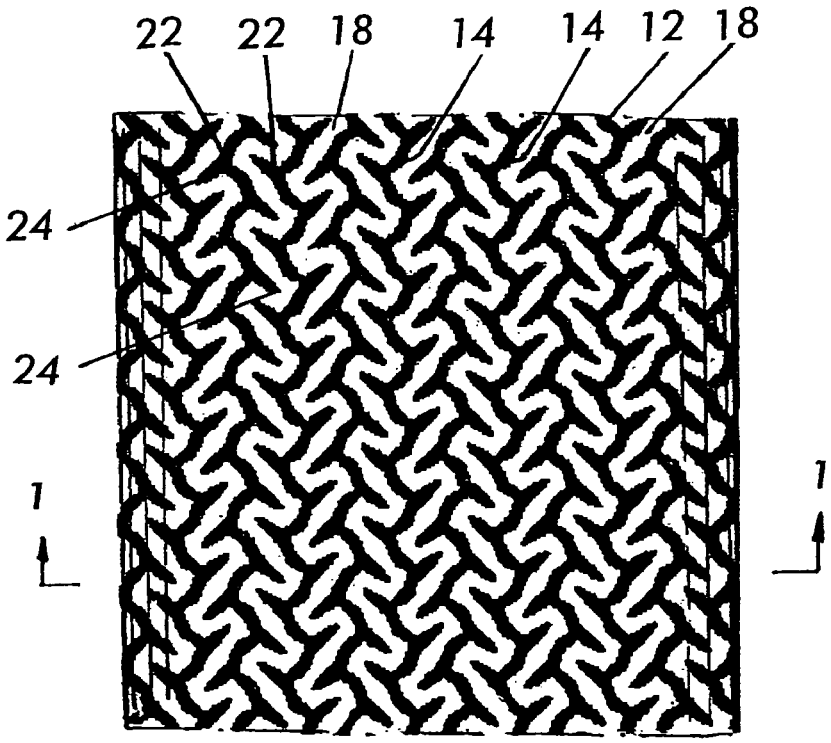
FIG. 2 is a plan view of the surface of the grip provided with a preferred embodiment of the invention.
Figure 3:
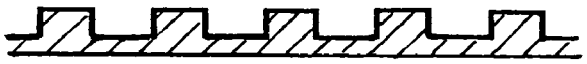
FIG. 3 is an enlargement in cross-section of the grip surface.

One preferred embodiment illustrating the present invention concerns a grip surface 10, which carries a micropattern 12 that is seen in plan in FIG. 2 and in section in FIGS. 1 and 3. The particular design of micropattern shown in the drawings is a preferred embodiment, but not the only embodiment of the invention.

The micropattern 12 is shown considerably enlarged in the drawings to show its features. Being a micropattern with the dimensions described above, the unmagnified pattern is visible to the eye, but its details may not be discerned, and it appears mostly as a texturing of the surface of the grip.

The micropattern 12, shown enlarged in the drawing, comprises continuous strands 14 or lines of ridges or ribs extending longitudinally along the length or along an axis of the grip, and the ridges are in an array, circumferentially around the longitudinal axis or axes of the grip. Not illustrated are alternative directions of the ridge arrays rather than longitudinal, including circumferential, oblique or spiral around the grip.

In the illustrated embodiment, the ridges 14 alternate in the circumferential direction with grooves 18 that also extend generally in a longitudinal direction of the grip and are parallel to the adjacent ridges. Each ridge is in the form of one or more line segments. Neighboring line elements of the line segments bend off obliquely from the longitudinal direction so that each ridge follows a zigzag path. Adjacent line elements are shown meeting at the line element ends at sharp corners. But the intersections between the ends of adjacent line elements may be rounded.

The zigzag path serves several functions. It affords the ridges a longitudinal dimension, so that the ridges resist circumferential movement of the grip in the hand. The path also affords the ridges a circumferential extent so that the ridges resist movement in the longitudinal direction of the grip in the hand. Hence, the zigzag pattern provides drag in both the longitudinal and circumferential directions. The bends or intersections between adjacent line elements and defining zigzags can be seen at 22 and they are disposed along the entire length of the ridge.

In the preferred form, at most of the bends or intersections 22 between line elements, the ridge continues with a short, free end extension or barb 24 continuing in an oblique direction, that is, the barb extends obliquely longitudinally up or down and left or right. The barbs need not extend only from the intersections between line elements, but may extend out of the line elements along the length of the elements. Especially for torsion control purposes, as is needed for a golf club, the zigzag design produces both a velvety feel and drag, both circumferentially and longitudinally. The zigzag lines of ridges 14 contact the user's hand or his gripping surface and dig in sufficiently to prevent slipping. The barbs 24 enhance the drag by creating resistance against the skin.

Dimensions and shape of a fine micropattern of ridges and grooves are described above. The above stated numerical values are examples and provide a sense of the fineness of the micropattern. Any of them can be varied within the concept of the invention to affect the performance criteria.

Adjacent longitudinally extending strands or ridges 14 are preferably parallel. Yet, the strands or ridges may not be precisely parallel, may be oblique to each other or even intersecting.

The lengths of the line elements between intersections, bends or zigs and zags are the same, so that the ridges can be positioned to almost contact each other, with narrow gaps between the zigzag line elements of adjacent longitudinal ridges. In a preferred form, the width of the gaps between adjacent ridges is approximately the same as the width of the ridges, or preferably within the above stated range of widths, because if either the ridges or the gaps are too wide relative to the other, the grip will not have a desirable velvety feel. This arrangement allows the micropattern to fill up as much space as possible on the surface, avoiding large spaces or gaps where the velvety drag feel might be lost.

The gap areas 18 between the ridges and barbs of neighboring strands or ridges are recessed. This defines moisture channels, like a tire tread, and allows skin contact against the dry ridge surfaces. Further, the numerous ridges and barbs on the gripping surface press into the skin and produce drag and resist torque and longitudinal motion.

The material of the microstructure with the micropattern is rubber or another elastomer. It is not a rigid material, but has slight elasticity and will therefore yield or bend slightly as the user's hand pressure is applied, providing a soft, velvety feel, rather than a hard, slick surface feel.

As has been noted, the micropattern material may be used on any grip surface. The micropattern may be formed in a layer of material, as shown in FIG. 1, that is laminated on a circumferential base, e.g., by laser engraving or molding it into the layer. Alternatively, the micropattern may be formed in the surface of the circumferential base or grip itself using a molding process, where the mold contains the micropattern, which pattern was formed in the mold, e.g. in a laser engraving process. Other techniques may be used for forming the ridges and grooves.

For appearance purposes or certain functional purposes, only a part or parts of the entire circumferential surface of the grip may be provided with the micropattern, such as the part likely to be grasped. The placement of the micropattern on the surface is a matter of choice of a designer.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A micropattern grip surface for use on a grip, comprising:

a plurality of ridges alternating with a plurality of grooves arrayed on the grip surface in a circumferential direction around an axis of the grip, wherein the ridges and grooves each have a generally longitudinal direction of extension component along the grip and generally along the direction of the axis and also each have a generally circumferential direction of extension component around the grip and the axis;

the ridges comprise successive zigging and zagging line elements of the ridges and the line elements include ends that intersect adjacent line elements so that the line elements provide the generally zigzag shape;

the ridges having a height above the depth of the grooves in the range of about 0.010-0.040 inch, a width of the ridges in the range of about 0.003 to 0.030 inch and a groove between the ridges in the same range as the width and the ridges being so shaped such that the ridges and grooves define a micropattern such that the ridges will yield or bend slightly under hand pressure and such that the ridges cooperate with a hand or object gripping the grip to resist both torque around the axis of the grip and longitudinal movement of the grip with reference to the hand or gripping object to prevent slippage.

2. The micropattem grip surface of claim 1, wherein the length of each line element is in the range of 0.025 to 0.250 inch.

3. The micropattern grip surface of claim 2, wherein the density of repeats of the zigzag pattern is about 1,000 details per square inch or less.

4. The microspattern grip surface of claim 1, wherein at least some of the ridges include a respective barb extending off at least some of the line elements and away from the line elements for providing additional drag.

5. The micropattern grip of claim 1, wherein the ridges are aligned in a direction of at least one of longitudinally along, circumferentially around, obliquely to the axis or spirally around surface

6. A micropattern grip surface for use on a grip, comprising:

a plurality of ridges alternating with a plurality of grooves arrayed on the grip surface in a circumferential direction around an axis of the grip, wherein the ridges and grooves each have a generally longitudinal direction of extension component along the grip and generally along the direction of the axis and also each have a generally circumferential direction of extension component around the grip and the axis;

the ridges being so shaped and of such height and the grooves being of such depth with respect to the surface of the grip, and the widths of the ridges and the grooves being such that the ridges and grooves define a micropattern such that the ridges will yield or bend slightly under hand pressure and such that the ridges cooperate with a hand or object gripping the grip to resist both torque around the axis of the grip and longitudinal movement of the grip with reference to the hand or gripping object to prevent slippage;

the ridges comprise successive zigging and zagging line elements of the ridges and each line element includes ends that intersect other line elements so that the line elements provide the generally zigzag shape;

each ridge includes a respective barb extending off at least at some line elements, and the barbs extending off the ridge for providing additional drag.

7. The micropattern grip surface of claim 6, wherein each barb is generally of the same height and width as the ridge from which the barb projects.

8. The micropattern grip surface of claim 6, wherein the adjacent line elements of the ridges and the barbs are so shaped that they are parallel and their zigzags and line elements are parallel, for enabling the ridges to be near each other and for the grooves between ridges to be of uniform width between adjacent ridges.

9. The micropattem grip surface of claim 8, wherein each of the barbs is so of oriented and of such length as to extend toward a line element of an adjacent ridge, without the barb contacting the line element of the adjacent ridge.

10. The micropattem grip surface of claim 6, wherein at least some of the barbs extend off a respective one of the intersections between adjacent line segments.

* * * * *